United States Patent [19]

Morton

[11] 4,408,567

[45] Oct. 11, 1983

[54] FURNACE CONSTRUCTION

[76] Inventor: Michael S. Morton, Box 923, Conway, N.H. 03818

[21] Appl. No.: 231,059

[22] Filed: Feb. 3, 1981

[51] Int. Cl.[3] ..... F22B 5/00

[52] U.S. Cl. ..... 122/14; 122/182 R; 122/162; 236/1 G; 237/19; 126/285 R

[58] Field of Search ..... 236/1 G; 237/19; 122/13 R, 14, 16–19, 149, 160, 161, 162, 178, 182 R, 182 T, 187, 367 R, 367 A; 126/285 R, 285 A, 290; 431/8

[56] References Cited

U.S. PATENT DOCUMENTS

| | | | |
|---|---|---|---|
| 895,280 | 8/1908 | Mackley | 122/161 |
| 1,196,117 | 8/1916 | Kiefer | 126/285 R |
| 1,806,216 | 5/1931 | Plummer | 122/19 |
| 1,841,230 | 1/1932 | Vuia et al. | 122/161 |
| 1,905,734 | 4/1933 | Morrow | 126/285 |
| 1,944,817 | 1/1934 | Thomas | 122/13 R |
| 1,991,557 | 2/1935 | Johnson | 122/14 |
| 2,112,554 | 3/1938 | Beam | 236/1 G |
| 2,224,705 | 12/1940 | Stringer | 236/1 G |
| 2,269,932 | 1/1942 | Field, Jr. | 236/1 G |
| 2,397,879 | 4/1946 | Morrow | 236/1 G |
| 2,464,701 | 3/1949 | Lyke | 122/149 |
| 2,506,336 | 5/1950 | Bock | 122/14 |
| 2,512,319 | 6/1950 | Ferguson | 431/181 |
| 2,592,863 | 4/1952 | Conner | 122/13 R |
| 2,781,174 | 2/1957 | Smith | 122/13 R |
| 2,832,320 | 4/1958 | Thome et al. | 122/161 |
| 3,341,122 | 9/1967 | Whittell, Jr. | 237/19 |
| 3,894,834 | 7/1975 | Estes | 431/8 |
| 4,143,811 | 3/1979 | Sattmann | 236/1 G |
| 4,294,226 | 10/1981 | Feinberg | 126/290 |

FOREIGN PATENT DOCUMENTS

| | | | |
|---|---|---|---|
| 825014 | 2/1938 | France | 122/162 |
| 249854 | 6/1926 | Italy | 122/162 |

*Primary Examiner*—Henry C. Yuen
*Attorney, Agent, or Firm*—Harvey B. Jacobson

[57] ABSTRACT

An fuel-fired hot water furnace includes the use of an improved combustion chamber, heat exchanger and breaching damper, and further includes utilizing the water heated in the furnace as the means of heating a separate domestic supply of water directed through a side car hot water heater in fluid communication with the furnace. The improved combustion chamber includes a primary combustion cylinder which is orthogonally attached to a secondary combustion cylinder, and the secondary combustion cylinder is provided with a necked-down discharge so as to facilitate a thorough burning of a fuel and air mixture. The heat exchanger includes a primary rise and fall arrangement for the combustion gases so as to provide for maximum heating of the water within the heat exchanger prior to the gases being emitted outwardly from the furnace through a breaching tube, and the breaching damper is provided within the breaching tube so as to regulate the rate of combustion gas flow. The breaching damper utilizes an adjustable stop to regulate gas flow, and further utilizes a mercury switch to shut off the fuel burner in the even that the damper is closed. The damper may also move beyond the adjustable stop position in the event of an undesirable increase in pressure within the furnace through the overcoming of a closing force exerted by a weighted stop arm. The side car water heater has an inner chamber through which the hot furnace water passes, and the domestic water to be heated is directed through loosely positioned coils in the inner chamber so that convection heat may be transferred from the heated furnace water to the domestic water supply.

16 Claims, 15 Drawing Figures

FIG. 11
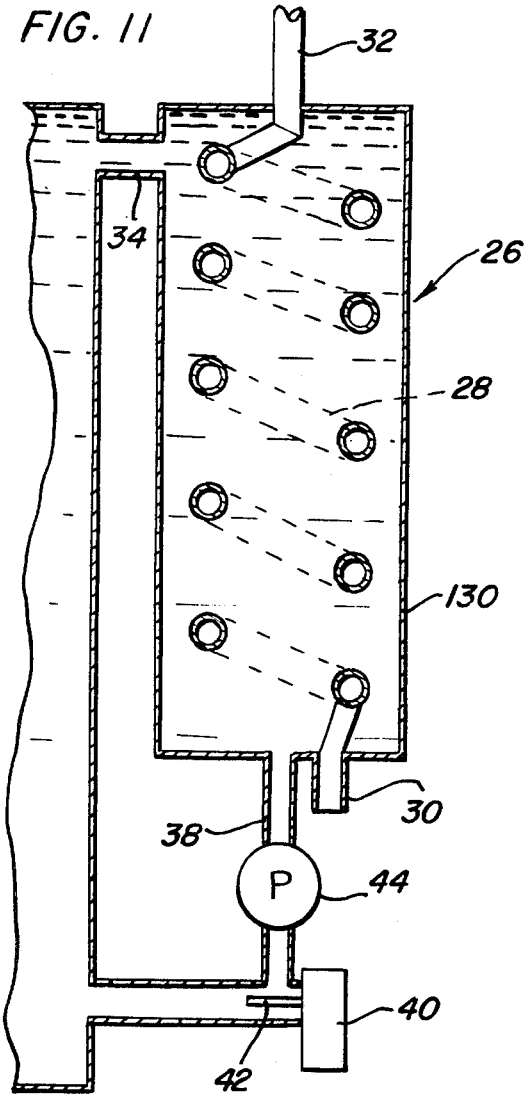
FIG. 8b
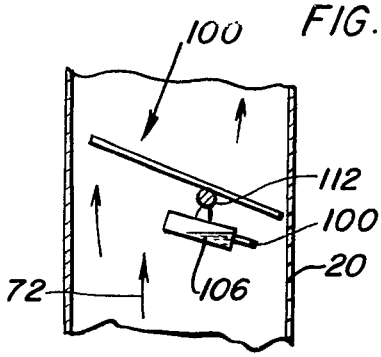
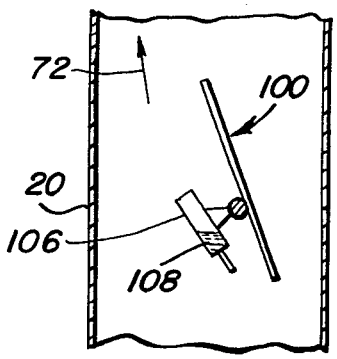
FIG. 8c
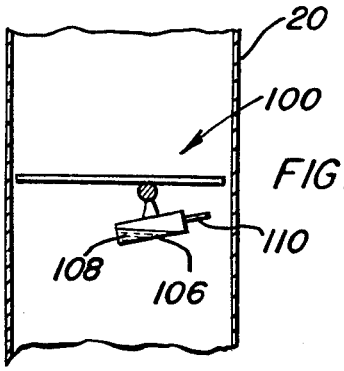
FIG. 8a
FIG. 7
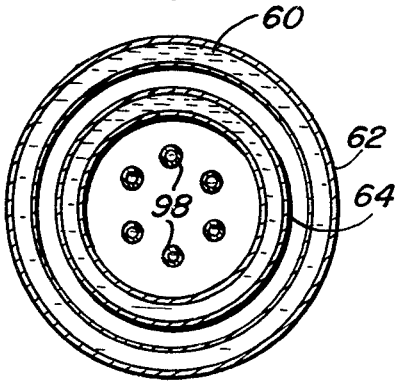
FIG. 12
PRIOR ART
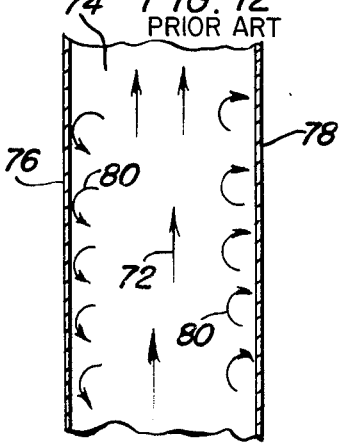
FIG. 13
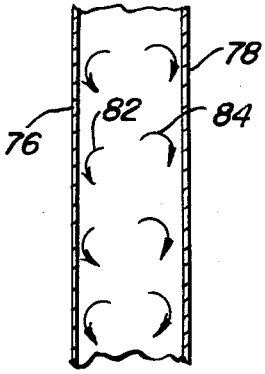

FURNACE CONSTRUCTION

BACKGROUND OF THE INVENTION

1. Field of the Invention

The present invention relates to hot water furnaces and more particularly pertains to an fuel-fired hot water furnace that utilizes an improved combustion chamber, heat exchanger and breaching damper to heat a domestic water supply passing through a side car or side container tank including a domestic hot water heater.

2. Description of the Prior Art

The use of hot water furnaces is generally well-known in the art, such furnaces typically being utilized to supply hot water for various uses. In this connection, prior art hot water furnaces typically include a fuel and air mixture directed to a combustiom chamber wherein the mixture is burned to create hot combustion gases. The hot gases are then generally conducted to a heat exchanger region which typically consists of tubes or coils through which water is flowing and around which the hot combustion gases pass. In this regard, heat from the hot combustion gases passes by convection through the outer surfaces of the tubes or coils to heat the water flowing therethrough. Once the hot combustion gases pass through the heat exchanger region of the hot water furnace, they are directed outwardly and away from the furnace through a breaching tube, which is effectively an exhaust stack, such tube typically using a breaching damper to regulate the flow of combustion gases out of the furnace.

Typical constructions of such prior art hot water furnaces are to be found in U.S. Pat. No. 3,171,388, issued Mar. 2, 1965, to Ganz, and in U.S. Pat. No. 4,157,698, issued June 12, 1979, to Viessmann. In both of these patents, hot combustion gases are utilized to heat supplies of water located in a hot water fuel-fired furnace.

With this basic concept thus understood, it can be appreciated that there exists many possibilities for improvement in the design and construction of hot water furnaces, specifically with respect to the design and construction of the combustion chambers, heat exchangers, breaching dampers, and methods for conveying the combustion gas heat to the water to be heated. In this connection, the present invention is directed to improvements in these identified portions of an fuel-fired hot water furnace.

SUMMARY OF THE INVENTION

The general purpose of the present invention, which will be described subsequently in greater detail, is to provide an improved hot water furnace that has all of the advantages of the prior art hot water furnaces and none of the disadvantages. To attain this, the present invention provides for improvements in a hot water furnace combustion chamber, the furnace heat exchanger and the furnace breaching damper. Further, the present invention utilizes the hot water generated in the furnace as the principal source of heat for heating a domestic supply of hot water, as opposed to using the hot combustion gases as the principal source of heat for the domestic water supply.

Specifically, the combustion chamber of the present invention utilizes a first or primary combustion cylinder which is perpendicularly attached to a secondary combustion cylinder having a necked down discharge. In effect, a fuel and air mixture is burned in the primary combustion cylinder and expands outwardly into the secondary combustion cylinder before being discharged through the necked-down portion as hot combustion gases to be utilized for heating a water supply.

The heat exchanger of the present invention contains the supply of water to be heated and is provided with a plurality of paths through which the hot combustion gases pass prior to being directed out of the furnace through a breaching tube. In this regard, the heat exchanger includes a first concentrically mounted, cylindrically-shaped water container about an inner periphery of which is formed a primary rise or flow path for the combustion gases, and a second concentrically mounted, cylindrically-shaped water container positioned inside the first container, whereby hot gases pass between the two containers during an upward flow. A primary fall or down flow path for the combustion gases is provided between an inner peripheral portion of the second container and a third concentrically mounted, cylindrically-shaped water container positioned within the second container and in a concentric abutting relationship with a bottommost portion of the breaching tube or exhaust stack, whereby the hot gases pass between the second and third containers during a downward flow. The hot gases are then directed into the bottommost portion of the breaching tube so as to flow past a breaching damper.

The breaching damper is designed to provide a back pressure on the upward flow of gases so as to further regulate the rate of combustion gas emission from the hot water furnace, as well as the amount of draft air supplied to the combustion process, so that maximum heat transfer from the combustion gases to the water being heated occurs before the gases are exhausted from the furnace. The damper includes an adjustable stop whereby a maximum opening setting can be provided to the damper, and further includes a weighted stop arm as a safety feature which allows the damper to open beyond the adjustable stop setting in the event of a substantial increase of pressure within the breaching tube and hence the furnace. Further, a mercury switch is provided which automatically shuts off the fuel supply to the furnace in the event that the damper closes during operation thereof.

The hot water generated within the furnace is directed to a side car domestic hot water heater which has loosely placed coils positioned therein, such coils having a separate supply of domestic water to be heated passing therethrough. In this connection, the hot water generated in the furnace supplies the heat by convection to the water in the coils to be heated, so as to result in one heated liquid being utilized to heat another liquid isolated therefrom. The transfer of heat from the hot water in the furnace to the domestic water supply may be facilitated through the use of a circulation pump and an aquastat which selectively activates the pump so as to maintain a constant supply of hot water passing over the coils.

It is therefore an object of the present invention to provide a hot water furnace that has all of the advantages of the prior art hot water furnaces and none of the disadvantages.

It is another object of the present invention to provide a hot water furnace that may be easily and economically manufactured.

It is a further object of the present invention to provide a hot water furnace that is simple and reliable in its operation.

Yet another object of the present invention is to provide a hot water furnace that utilizes an improved combustion chamber to facilitate a burning of a fuel and air mixture supplied thereto.

A still further object of the present invention is to provide a hot water furnace that utilizes an improved heat exchanger for facilitating a maximum transfer of the heat of combustion to a hot water supply.

Even another object of the present invention is to provide a hot water furnace that employs the use of a breaching damper which efficiently controls the back pressure of the combustion gases being exhausted from the furnace.

Yet still a further object of the present invention is to provide a hot water furnace that utilizes a breaching damper which will cut off the fuel supply to the furnace in the event that the damper closes.

An even further object of the present invention is to provide a hot water furnace that utilizes a breaching damper having an adjustable stop.

Even yet another object of the present invention is to provide a hot water furnace that utilizes its heated water supply as a primary source of heat for a domestic water supply to be heated.

Yet even a further object of the present invention is to provide a hot water furnace having a side car or tank domestic hot water heater in fluid communication therewith.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 7 is a sectional view taken along the line 7—7 of FIG. 4.

FIGS. *8a–8c* are schematic representations of the various operating positions of the breaching damper used in combination with the present invention.

Figure 9:
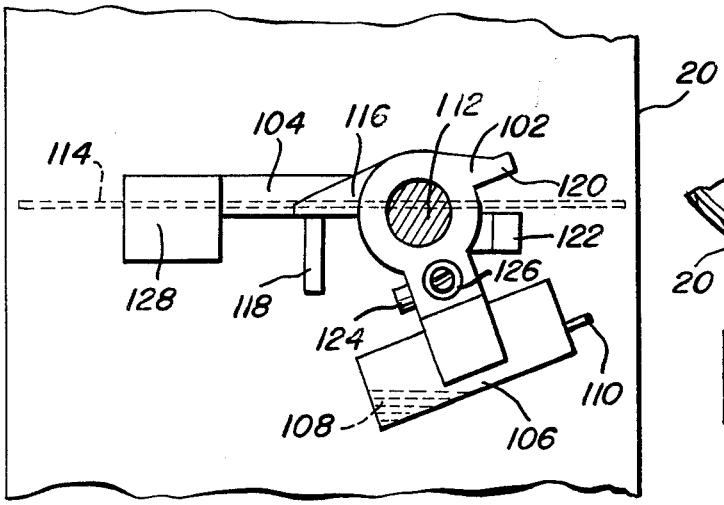

FIG. 9 is a side elevation view of the adjustable stop mechanism used in conjunction with the breaching damper of the present invention.

Figure 10:
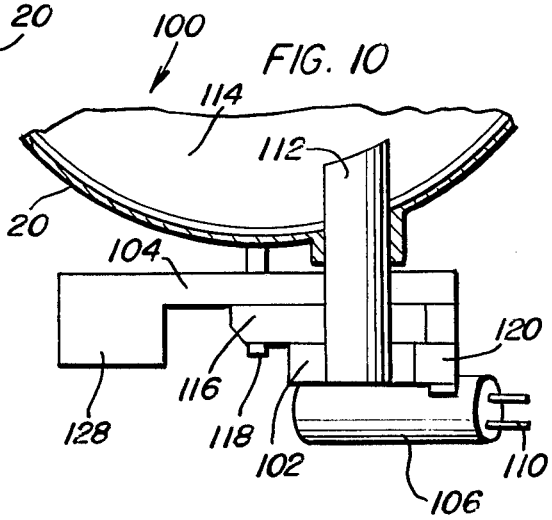

FIG. 10 is a top plan view of the adjustable stop mechanism illustrated in FIG. 9.

Figure 1:
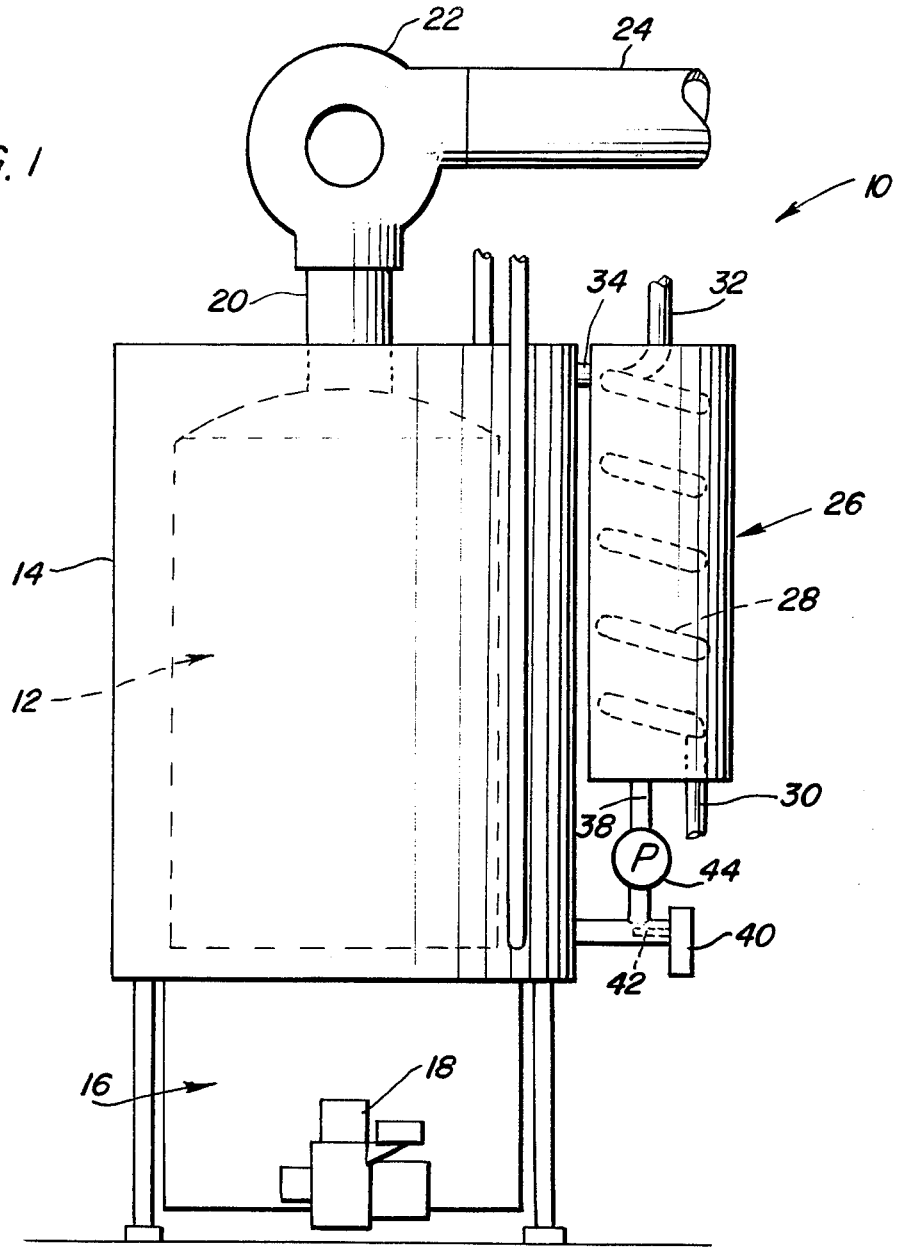
FIG. 1 is a side elevation view of a hot water furnace illustrating the basic components of the present invention.

FIG. 11 is a detailed structural view of the side car domestic hot water heater illustrated in FIG. 1 and as used in the combination of the present invention.

FIG. 12 is a flow diagram of combustion gases through a typical heat exchanger tube as employed in the prior art.

FIG. 13 is a flow diagram of the combustion gas through the heat exchanger of the present invention.

DESCRIPTION OF THE PREFERRED EMBODIMENT

With reference now to the drawings and in particular to FIG. 1, a hot water furnace embodying the principles and concepts of the present invention and as generally designated by the reference numeral 10 will be described in detail. Specifically, it can be seen that the hot water boiler or furnace 10 includes a heat exchanger 12 positioned within a furnace housing 14 and a combustion chamber 16 positioned below the heat exchanger. In this regard, the combustion chamber 16 has a fuel burner 18, such as an oil burner or the like, operably attached thereto, and an exhaust stack or breaching tube 20 is shown being directed away from the heat exchanger 12 so as to provide a means of exhausting the combustion gases from the combustion chamber 16. Further, a draft fan 22 is shown in fluid communication with the breaching tube 20, such draft fan being operable to provide a suction on the breaching tube in a manner which will facilitate a removal of the combustion gases from the hot water furnace 10. An exhaust stack 24 is operably attached to and directed away from the draft fan 22 whereby the combustion gases may be directed to the atmosphere or other location as desired.

Also illustrated in FIG. 1 is a side car or tank domestic hot water heater 26 having a plurality of loosely positioned coils 28 contained therein, such coils serving as a conduit for a domestic water supply which may be directed through the hot water heater. In this connection, the coils 28 include a domestic water supply inlet conduit 30 and a water supply outlet conduit 32. By the same token, the side car or tank domestic hot water heater 26 has an inlet conduit 34 for fluidly connecting the same the heat exchanger 12 within hot water furnace 10. This inlet conduit 34 provides a path for the hot water in the heat exchanger 12 to flow into the hot water heater 26, while an outlet conduit 38 is provided on a bottommost portion of the hot water heater, such outlet conduit serving to direct the hot water within the heater back into the furnace heat exchanger 12. Additionally, an aquastat 40 having a temperature probe 42 is positioned in fluid communication with the outlet conduit 38 and is operable in response to temperature changes within the water contained in the outlet conduit 38 to selectively operate a water circulating pump 44.

Figure 3:
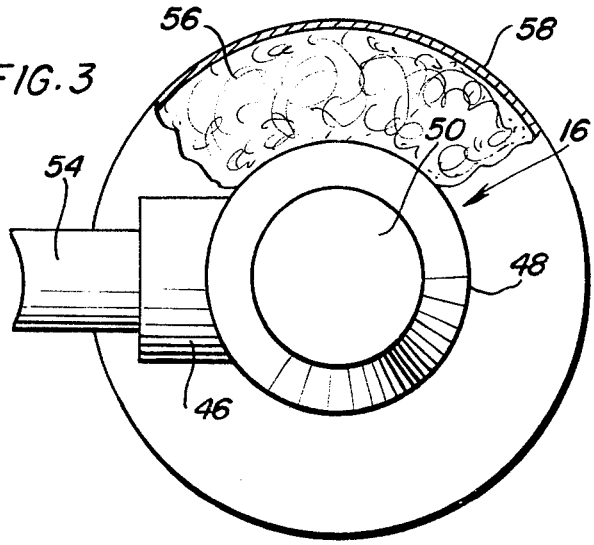
FIG. 3 is a top plan view of the combustion chamber utilized in the present invention.
Figure 2:
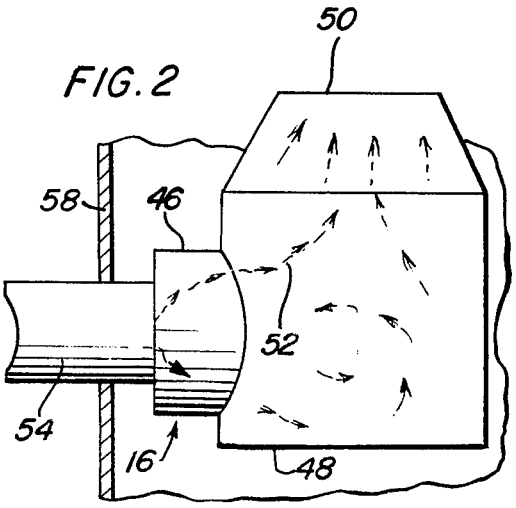
FIG. 2 is a side elevation view of the combustion chamber as utilized in the present invention.

FIGS. 2 and 3 serve to illustrate the specific constructional details of the combustion chamber 16 as used in the combination of the present invention. Unlike conventional combustion chambers of rectangular or cylindrical "pot" design, the combustion chamber 16 of the present invention incorporates a geometric design to increase eddy flow, increase the surface area of refractory lining of the primary cylinder 46 and the increase ability to retain a combustion fire within the combustion chamber. This is accomplished by using a primary horizontal combustion cylinder 46 intersecting with a vertical secondary combustion cylinder 48 which is necked down at the discharge 50 thereof. The fire flow, as indicated by the arrows 52 in FIG. 2, is directed outwardly from the burner air and fuel supply tube 54 and is somewhat compressed or bent inward by the primary cylinder 46 so as to maintain the fire flow in a horizontal axial alignment with the supply tube 54. At the same time, the refractory lining of the primary cylinder 46 returns radiant heat back to the fire, thus helping to vaporize the fuel spray being emitted from the supply tube 54. At the intersection with the secondary cylinder 48, the fire is again allowed to turn outward, thus setting up strong eddy currents in the secondary cylinder which results in excellent mixing of rich and lean portions of the fire. Necking at the discharge 50 returns additional radiant heat into the secondary cylinder fire, while the restriction to flow caused by the necked-down discharge helps to contain the fire within the secondary cylinder 48. This restriction caused by the discharge 50 also prevents cooler gases present in the heat exchanger 12 from entering the combustion chamber 16.

As can be appreciated, the combustion chamber 16 of the present invention is strictly a post burner unit. In this respect, no means for introduction of fuel, combustion air, or the ignition of a mixture of the same is discussed, since such details are provided by conventional state of the art burners. Specifically, the purpose of the combustion chamber 16 forming a part of the present invention is to augment combustion by retaining the combustion process therein through completion, before allowing the combustion gases to come into contact with cooler heat exchanger surfaces which could possibly extinguish a portion of the combustion before such completion. As such, it is envisioned that conventional state of the art burners, preferably of the "flame retention" type, could be used to introduce fuel and air to the combustion chamber 16, while it is also recognized that any conventional method of heat withdrawal, whether in the form of heated water or otherwise, can be employed to make use of the heat generated by the furnace 10. Accordingly, the apparatus and manner of introducing an air and fuel mixture to the furnace 10, as well as the manner of utilizing the heat generated by the furnace other than that manner specifically disclosed below, forms no part of the present invention and no further discussion relative thereto will be provided.

Lastly illustrated in FIGS. 2 and 3 is the fact that the primary and secondary combustion cylinders 46, 48, respectively, are encircled by and contained within a substantial layer of insulation material 56, such insulation material itself being retained in position by an outer shell or housing 58 which encircles the combustion chamber 16. As can be appreciated, the insulation material 56 serves to retain the heat of combustion within the combustion chamber 16 until such time as the same is directed outwardly through the discharge 50 and up into contact with the heat exchanger 12.

Figure 4:
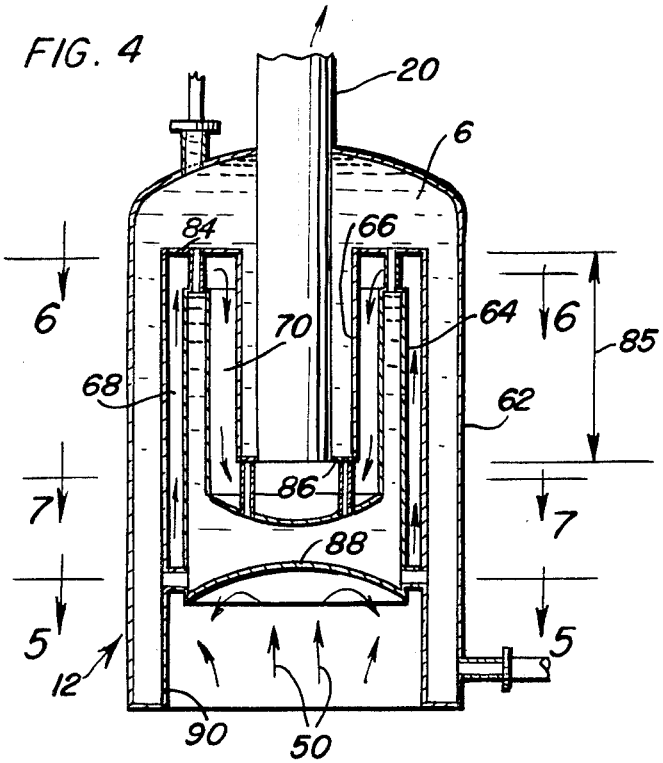
FIG. 4 is a side elevation view, partly broken away, of the heat exchanger employed in the present invention.

Referring now to FIG. 4 of the drawings, a description of the heat exchanger 12 forming a part of the combination of the present invention will be provided. In this respect, it can be seen that the heat exchanger 12 incorporates a unique vertical tube within a tube arrangement. Specifically, the heat exchanger 12 is essentially a large water jacket having boiler liquid or water 60 contained therein and includes the use of three cylindrically-shaped, concentrically mounted water containers 62, 64, 66 which are integrally joined together and are in fluid communication with one another. A primary rise 68 is defined as a cylindrically-shaped difference space or annular space between the first cylindrically-shaped concentrically mounted water container 62 and the second cylindrically-shaped concentrically mounted water container 64. In this respect, the primary rise 68 serves to provide a flow path for the combustion gas upwardly between the water containers 62, 64, and a primary fall 70 is defined as a cylindrically-shaped difference space or annular space between the second cylindrically-shaped concentrically mounted water container 64 and a third cylindrically-shaped concentrically mounted wall or water container 66. In effect, the primary fall 70 serves as a downward flow path for the combustion gases between the second and third water containers 64, 66, respectively, and further serves as the conduit for directing the combustion gases into the breaching tube 20. By this design, a primary rise 68 is provided which has a large cross-sectional area so as to keep the flow velocity of the combustion gases down, thereby maximizing the amount of time during which heat convection can occur between the gases and the boiler liquid 60, while at the same time the space between the first and second water containers 62, 64 is very narrow so as to result in a close "squeeze" for the combustion gases between the containers. In this respect, reference is made to FIG. 12 of the drawings which illustrates a conventional heat exchanger construction having a flow of combustion gases 72 through a space 74 and further having respective sidewalls 76, 78 through which combustion gas heat is transferrable to a liquid contained on the other side of the walls. As can be appreciated with reference to this drawing, such a normal and conventional gas flow 72 results in an eddy flow 80 of gases next to the surfaces of the sidewalls 76, 78, so that the major flow of combustion gas 72 passes directly through the space 74 without ever transferring heat through the respective sidewalls 76, 78.

Contrary to this lack of efficiency as present in conventional prior art heat exchangers, the aforementioned "squeeze" present in the primary rise 68 of the present invention prevents high temperature gases from escaping between the two surface eddies 82, 84 as illustrated in FIG. 13. Specifically, a narrow space between the sidewalls 76, 78 as shown in FIG. 13 prevents a primary flow 72 of combustion gases through the heat exchanger 16 in the manner illustrated in FIG. 12. This arrangement, of course, is not possible in the conventional prior art heat exchangers since such a narrowing or "squeezing" of the space within the heat exchanger would result in a tremendous loss of surface area, such loss of area not being experienced by the construction of the present invention.

Similarly, a very narrow space which provides a further "squeeze" on the flow of combustion gases is provided between the water containers 64, 66 in the region identified as the primary fall 70. Accordingly, it can be appreciated the velocity of flow of combustion gases is maintained at a minimum throughout the entire heat exchanger 12, while the use of the large cylindrically-shaped spaces identified as the primary rise and fall 68, 70, respectively, permit the use of a maximum surface area for conducting heat from the gases to the boiler water 60.

Further identified with reference to FIG. 4 is a heat trap area 85 which is defined as the distance between the topmost portion 84 of the primary rise 68 and the bottommost portion 86 of the third cylindrically-shaped water container 66. Effectively, this heat trap area 85 tends to hold or retain the hotter combustion gases in the heat exchanger 12, while the cooler combustion gases migrate downwardly through the primary fall 70 so as to be exhausted outwardly through the breaching tube 20. This effect occurs due to the fact that the cooler combustion gases are more dense, thus resulting in their migration downwardly through the primary fall 70, while the less dense hotter combustion gases are retained within the heat trap 85. A similar heat trap effect is provided by an upwardly concave-shaped surface 88 formed on a bottom portion of the heat exchanger 12 and being further bounded by a cylindrically-shaped sidewall 90. The concave surface 88 serves to retain the hottest combustion gases in direct contact therewith so as to maximize the heating effect on the boiler liquid 60, and as these gases cool, they migrate downwardly along the surface 88 to eventually enter into the primary rise 68 for eventual ejectment from the furnace 10.

Figure 5:
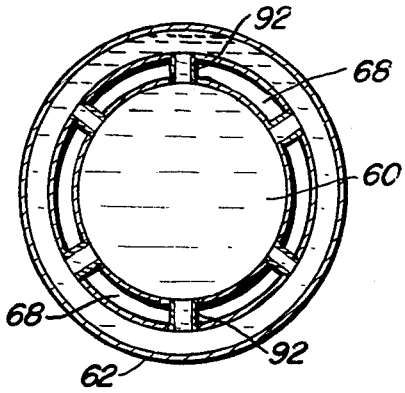
FIG. 5 is a sectional view of the heat exchanger of the present invention taken along the line 5—5 of FIG. 4.
Figure 6:
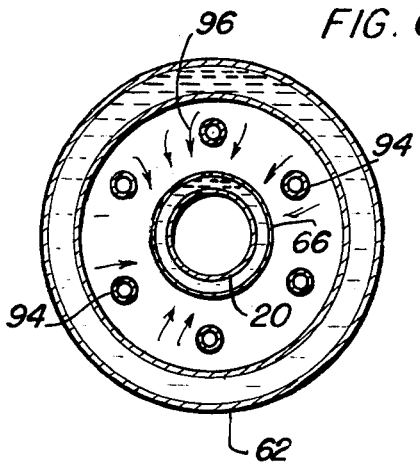
FIG. 6 is a sectional view taken along the line 6—6 of FIG. 4.

As to the manner of retaining the water containers 62, 64, 66 in fluid and integral connection with one another, reference is first made to FIG. 5 of the drawings wherein it can be seen that a set of transfer tubes 92, of which only six are shown, may be provided of a number and size sufficient to allow the boiler water 60, flowing from the water container 62, to enter the water containers 64 and 66 across a lower portion of the primary rise 68. By the same token, FIG. 6 shows a set of transfer tubes 94 (only six shown) of a number and size sufficient to allow the boiler water 60 heated in the region between the primary rise 68 and the primary fall 70 to convect to the upper region of the boiler through the crossover of the primary rise to the primary fall passage. FIG. 6 further illustrates the flow of the combustion gases 96 around the transfer tubes 94 so as to move from the primary rise 68 to the primary fall 70 in the manner aforementioned.

Finally, FIG. 7 illustrates a set of transfer tubes 98, of which only six are shown, which are of sufficient size and number to permit the boiler water 60 to enter the region between the primary fall 70 and the breaching tube 20 through the crossover of the primary fall to the breaching tube. As can be appreciated then, the above three sets of transfer tubes 92, 94, 98 may vary in size and number depending upon the size and capacity of the particular hot water furnace 10 and serve to support the inner or second water container 64, while permitting the necessary flow of boiler liquid 60 through the furnace. Additionally, the particular described construction permits the desired flow of hot combustion gases, as illustrated by arrows in the drawings, thereby to fulfill the intent of purpose and construction of the present invention.

Reference is next made to FIGS. 8*a*–8*c* of the drawings for a description of the breaching damper 100 as used in the combination of the present invention. Specifically, the breaching damper 100 is pivotally positioned within the breaching tube 20 and is operably positionable in either a standby mode (FIG. 8*a*), a run mode (FIG. 8*b*) or an overdraft position or mode (FIG. 8*c*). In the standby mode as illustrated in FIG. 8*a*, the damper 100 is shut, thus acting as a heat capacitor and preventing a flow of combustion gases upwardly through the breaching tube 20. This position prevents convection cooling of the heat exchanger 12 through a flow of cooled gases upwardly through the breaching tube 20 and is typically assumed when the draft fan 22 is not operable. When the furnace 10 is operable, i.e., a burner is supplying fuel to the combustion chamber and the draft fan 22 is running, the breaching damper 100 is partially open as shown in FIG. 8*b*, thus to regulate the abundant draft generated by the draft fan to a constant level over the combustion fire. In this respect, the breaching damper 100 is provided with an adjustable stop 102, which will be subsequently described with reference to FIGS. 9 and 10 of the drawings and which facilitates a control of the amount of draft air provided to the combustion fire, as well as the rate of flow of the combustion gases through the heat exchanger 12 and upwardly through the breaching tube 20. The adjustable stop 102 rests on a weighted stop arm 104, also to be subsequently described with reference to FIGS. 9 and 10 of the drawings, such weighted arm permitting the damper 100 to open further to the position illustrated in FIG. 8*c*, so as to relieve any positive pressure (referred to as overdraft) in the heat exchanger 12 and the combustion chamber 16. Such an overdraft typically occurs due to a minor explosion which may occur during an ignition of a burner unit, and in effect then, the weighted arm 104 in combination with the adjustable stop 102 serves as a safety pressure release to prevent damage to the furnace 10 in the event of a substantial rapid increase of combustion gas pressure within the furnace. Also illustrated in FIGS. 8*a*–8*c* is the use of a mercury switch 106 operably attached to the damper 100 and wired so that the burner cannot run unless the damper is opened to one of its run positions illustrated in FIGS. 8*b* and 8*c*. In this connection, a supply of mercury 108 may be brought into contact with an open circuit at the ends of an electrical lead connection 110 so as to close the circuit and permit electric power to be supplied to a fuel supplying pump operably connected to a conventional burner. As such, when an open circuit is present, the fuel supply pump will be shut down, this cutting off the fuel supply to the burner and thus shutting down the furnace 10. Both FIGS. 8*b* and 8*c* show the mercury 108 in operable contact with the electrical lead connection 110 so as to permit a functioning of a fuel supplying pump, while FIG. 8*a* shows the mercury in a removed position from the electrical lead connection 110 in a manner which would result in a shutdown of the fuel pump. This feature is provided in the event that the damper 100 might be wedged shut while combustion gases were being generated within the furnace 10. As can be appreciated, the increased pressure within the furnace 10 caused by the generation of the combustion gases could result in a substantial explosion if the damper 100 prevented the combustion gases from being emitted outwardly through the breaching tube 20.

With reference now to FIGS. 9 and 10 of the drawings, a further and more detailed description of the breaching damper 100 along with its adjustable stop 102 and weighted arm 104 will be provided. In this connection, it can be seen that the damper 100 is pivotable about a rotatable damper shaft 112 offset from the center of the damper plate 114, such plate being fixedly attached to the shaft. This offset positioning results in an unbalanced retention of the damper plate 114 within the breaching tube 20, whereby the breaching damper 100 is then sensitive to pressure differentials on the plate. The damper housing is effectively a continuous integral part of the breaching tube 20, and as is evident with reference to FIG. 10 of the drawings, the damper plate 114 is similarly offset from the center of the breaching tube 20, as well as being offset from the center of the damper plate 114. In that the damper plate 114 is round and fits in the round breaching tube 20 with a minimum amount of clearance, a much greater combustion gas flow area is provided on one side of the rotatable damper shaft 112, as illustrated in FIGS. 8*b* and 8*c*, so that this unbalanced situation causes the damper shaft 112 to tend to pivot counterclockwise as viewed in FIGS. 8*a*–8*c* and 9. This counterclockwise rotational movement is stopped when the breaching damper 100 reaches a closed position (FIG. 8*a*) by a fixed stop 116 which is fixedly secured to the damper shaft 112 and which is abuttable against a second stop or projection 118 fixedly secured to and extending outwardly from an outer surface of the breaching tube 20. In this respect, the fixed stop 116 is abuttable against the projection 118 so as to prevent any additional counterclockwise rotation of the damper shaft 112 which would result in the damper plate 114 moving in a counterclockwise position beyond the closed position illustrated in FIG. 8*a*. By the same token, the adjustable stop 102 is shown adjustably secured in position on the damper shaft 112, such adjustable stop having a projection 120 extending therefrom which is abuttable against an extending portion or projection 122 integrally a part of the aforedescribed weighted arm 104. Effectively then, the adjustable stop 102 may be rotatably varied in position on the damper shaft 112 in a manner which controls the run position of the breaching damper 100 as illustrated in FIG. 8*b*. Specifically, an adjustment of the adjustable stop 102 which is effected by rotating the same in a counterclockwise direction about the damper shaft 112 will permit a greater clockwise rotation of the shaft prior to the projection 120 coming into an abutting relationship with the extending projection 122. This, of course, results in the damper plate 114 being allowed to move to a more open position whereby a greater and more rapid flow of combustion gases upwardly through the breaching tube 20 may be facilitated. Similarly, a clockwise adjustment of the adjustable stop 102 on the damper shaft 112 will result in a limiting of the movement of the damper plate 114 to an open position, thus to decrease the rate of flow of combustion gases out of the furnace 10.

Further illustrated in FIGS. 9 and 10 is the aforedescribed mercury switch 106 which is operably and fixedly attached to the adjustable stop 102. As shown in FIG. 9, the mercury switch 106 is in the position where its contacts or electrical leads 110 are in a position whereby an open circuit is created thus preventing an operation of a fuel supply pump. In this connection, the mercury switch 106 will typically be wired in series connection between a state of the art primary controller (not shown) and the aforementioned burner. By the same token, the draft fan 22 is wired in parallel with the primary controller, which is effectively the means by which the fuel supply pump is operated, so that once the draft fan is started, the damper plate 114 will rotate along with the shaft 112 to a position whereby the fuel supply pump operated by the primary controller may be started.

The amount of draft provided through the furnace 10 can be adjusted by means of an adjusting screw 124 operable to cause a rotation of the adjustable stop 102 about the damper shaft 112, and the selected adjusted position may be locked or secured by a locking screw 126. Furthermore, by means of the correct weight 128 used on the weighted arm 104, positive gas pressure within the heat exchanger 12 can be relieved or increased as desired.

FIG. 11 more specifically illustrates the construction of the side car domestic hot water heater 26 as utilized in the combination of the present invention. The side tank hot water heater 26 enables a greater quantity of domestic water to be heated at a faster rate by reversing the general conventional practice of utilizing high density heat transfer, and not relying on convection alone to circulate the heated furnace water. The coils 28 of the exchanger 12 are loosely placed in a container or vessel 130 attached to and in fluid communication with the furnace 10. In this respect, the hot water heater 26 would typically be attached as a tank to a side of the furnace 10, thus giving rise to the name "side car" utilized in reference thereto. In this regard, the furnace fluid or water 60 may freely flow through the inlet conduit 34 into an interior portion of the vessel 130 so as to come into contact with the loosely placed coils 28. The hot furnace water 60 may then flow on through the vessel 130 and outwardly through the outlet conduit 38 so as to re-enter an interior portion of the furnace 10. In this connection, it can be appreciated that the highest temperature water is positioned at the top of the furnace 10, while the cooler water is located in a bottommost portion, so that higher temperature water 60 flows through the inlet conduit 34 into the water heater 26. As this water then cools, it migrates downwardly through the vessel 130 so as to flow outwardly through the outlet conduit 38 back into the furnace for re-heating. Effectively then, this construction permits for a convection flow of water 60 through the hot water heater 26 in the manner just described. Of course, as is apparent, domestic water being supplied to the coils 28 through the inlet conduit 30 is heated by the convection heat transfer from the hot boiler water 60 through the coils. Once the domestic water is sufficiently heated, it passes outwardly through the outlet conduit 32 of the hot water 26 so as to be directed to whatever domestic uses are desired. If domestic water usage is low, convection alone will circulate the furnace water 60 through the hot water heater 26. As the domestic water usage increases, however, the temperature of the furnace water convecting downward decreases, and the aforementioned aquastat 40 will sense this temperature change through its temperature probe 42 and will then start the water circulating pump 44 so as to increase the flow of heated boiler fluid 60 through the hot water heater 26. Thus, there is always an ample amount of heat applied to the heat exchanger coils 28 so as to facilitate a proper and desired heating of the domestic water supply.

In operation, it can be seen that a fuel and air mixture may be supplied by a burner unit 18 to the combustion chamber 16 of the present invention. As shown in FIG. 2 of the drawings, the combustion process is initiated in the primary combustion cylinder 46 and attempts to expand outwardly therefrom; however, the shape of the primary combustion cylinder 46 forces the flame somewhat inwardly until it reaches the secondary vertical combustion cylinder 48 where it again expands so as to create a substantial turbulence within the combustion chamber to facilitate a thorough mixing of the fuel and air supply for combustion. At the same time, the combustion chamber utilizes a necked-down discharge 50 which reflects heat back into the combustion process, just as the interior wall of the primary combustion cylinder does, so as to further facilitate combustion, while the necked-down portion further retards the outward flow of the combustion gases from the combustion chamber, so as to allow an increased period for burning of the fuel and air mixture. As such, a thorough combustion of the fuel and air mixture is achieved, while a maximum amount of combustion gases are created for use in the heat exchanger 12 of the invention.

Once the combustion gases are emitted through the discharge 50 of the combustion chamber 16, they flow upwardly towards the heat exchanger 12 and come into contact with a lower concave surface 88 thereof. At this point, an initial convection heating of the boiler water 60 occurs due to heat being transferred from the combustion gases through the wall defined by the concave surface 88, and as the gases cool in response to this convection heating, they migrate downwardly along the surface and into the intake of the primary rise 68. At this point of operation, the gases flow upwardly through the primary rise 68 heating the water 60 contained in the outer or first cylindrical container 62 and the second or intermediate cylindrical container 64. During this flow through the primary rise 68, maximum heat transfer is achieved due to the "squeeze" afforded by the very close positioning of the respective containers 62, 64 relative to one another. Once the combustion gases hit the topmost portion 84 of the primary rise 68, they flow past the transfer tubes 94 into the region of the primary fall 70 and thence downwardly toward the transfer tubes 98. During this downward flow through the primary fall 70, additional heat is given up by the combustion gases by a convection passing of the same into the second water container 64 and the third or inner water container 66. Further, an additional "squeeze" is provided in this space to increase the amount of heat transfer even more. The combustion gases finally are drawn into the breaching tube 20, subsequently to a final heat transfer between the gases which occurs through an additional passing of heat through the inner wall of the cylindrically-shaped water container 66.

As the combustion gases move outwardly from the heat exchanger 12, their movement is retarded by the above-described positioning of the breaching damper 100 within the breaching tube 20. Specifically, the flow of combustion gases through the breaching tube 20 is facilitated by an operation of the draft fan 22, a shown in FIG. 1, and this operation of the draft fan facilitates a movement of the breaching damper 100, as shown in FIG. 8*a*, into the run position, as shown in FIG. 8*b*. If it is observed by an operator that the temperature of the boiler water 60 is not at a desired level, the positioning of the breaching damper 100 may be adjusted by the aforedescribed rotation of the adjustable stop 102 about the damper shaft 112. In this respect, the upward flow of the combustion gases creates a pressure against the damper plate 114, causing the same to assume the run position illustrated in FIG. 8*b*, while the mercury switch 106 rotates in a clockwise manner so as to close the contacts 110 associated with the primary controller which operates the fuel supply pump. The clockwise force provided by the draft fan is sufficient to overcome the counterclockwise force afforded by the weighted arm 104, so that the stop projection 120 is brought into abutment with the weighted arm extension or projection 122, which thus brings the damper plate 114 into its maximum run position. In the event that a substantial increase of pressure is suddenly realized within the furnace 10, this increased pressure will act against the damper plate 114 thus attempting to cause a further clockwise rotation of the damper shaft 112 against the weight of the weighted arm 104. As can be appreciated, if this additional force is sufficient to the extent that damage might occur to the furnace in the event that the additional pressure is not relieved through the breaching tube 20, the counterclockwise force of the weighted arm 104 will be overcome, thus allowing a rotation of the same in a clockwise direction as afforded by the projection 120 abutting against the arm extension projection 122.

While the operation of the furnace per se has been described with respect to the movement of the combustion gases therethrough, it can next be appreciated that the heated boiler water 60 may be directed to the aforedescribed side car or tank domestic hot water heater 26. The heated boiler water 60 is directed downwardly over the loosely placed coils 28 in the heater 26 so as to heat the domestic water supply passing through the coils, and in the event that a sufficient amount of heating is not occurring, the aquastat 40 will sense the same with its temperature probe 42 and will cause an activation of the water circulating pump 44 so as to further increase the amount of heated boiler water 60 passing through the hot water heater.

In summary, it can be appreciated that the present invention represents a substantial improvement over the prior art, to include improved design and construction of combustion chambers, heat exchangers, breaching dampers and methods of supplying heat to a domestic hot water heater. In respect to the above description, it should be realized that the optimum dimensional relationships for the parts of the invention are deemed readily apparent and obvious to one skilled in the art, and all equivalent relationships to those illustrated in the drawings and described in the specification are intended to be encompassed by the present invention. In this regard, minor modifications may be made to the present invention without departing from the scope or intended coverage of the same. For example, the boiler construction may be of welded steel sheet of a thickness necessary to withstand pressures developed within the boiler, while in the alternative, the boiler may be of a cast construction. Similarly, a stop may be utilized on the breaching damper 20 to prevent the damper 100 and the weighted stop arm 104 from moving beyond a 90° turning angle, thus keeping them in the desired positions for operation. Further, a terminal board for the necessary electrical connections and a cover to protect all of the above parts from dirt, dust and mechanical interference may be provided.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fuel-fired hot water furnace, said furnace comprising:

fuel and air supply means for facilitating a combustion process in said furnace;

combustion chamber means in which said combustion process occurs;

said combustion chamber means including a horizontal primary combustion chamber in orthogonal communication with a secondary vertical combustion chamber, said combustion process being initiated in said primary chamber and continuing in said secondary chamber;

heat exchanger means for facilitating an exchange of heat between combustion gases generated in said combustion process and said water so as to heat said water, said heat exchanger means including a first set of surfaces forming an annular space means directing combustion gases upwardly along one side of said first set of said surfaces and providing a primary rise for flow of combustion gases between said first set of surfaces, a cylindrically-shaped outer water container means and cylindrically-shaped inner water container means defined by the proximate surface of said first set of surfaces and concentrically positioned within said heat exchanger means whereby said combustion gases must move upwardly along said surfaces, a second set of surfaces forming another annular space means for directing said combination gases downwardly along said second set of surfaces and providing a primary fall for flow of said combustion gases between said second set of surfaces and forming at least another surface of said inner water container means so as to facilitate exchange of heat between said combustion gases and said water;

combustion gas exhaust means for removing said combustion gases from said heat exchanger, said combustion gas exhaust means including a breaching tube through which said combustion gases are exhausted to a desired location, said combustion gas exhaust means further including a breaching damper positioned within said breaching tube for controlling a rate of flow of said combustion gases outwardly through said breaching tube, said breaching damper including an adjustable stop operable to limit positioning of said damper during operation of said furnace; and domestic hot water heating means, said domestic hot water heating means including a side container means including a hot water heater in fluid communication with said hot water contained in said furnace, said furnace water being utilized to heat a domestic water supply separately passing through said side container means including said domestic hot water heater.

2. The hot water furnace as defined in claim 1, wherein said heat exchanger means comprises a heat trap means so that higher temperature gases are retained in a heat transferring relationship with said water for a longer period of time than are lower temperature combustion gases.

3. The hot water furnace as defined in claim 2, wherein said breaching tube extends downwardly into a portion of said heat exchanger means.

4. The hot water furnace as defined in claim 3, wherein a further water container means is provided along an end portion of said breaching tube so as to further facilitate exchange of heat between said combustion gases and said water.

5. The hot water furnace as defined in claim 4, wherein said heat exchanger means is provided with a bottom concavely-shaped surface which increases exchange of heat between said combustion gases and said water through prolonging contact between said water and said higher temperature combustion gases.

6. The hot water furnace as defined in claim 4, wherein said further water container means is concentrically mounted in an abutting relationship with said breaching tube.

7. The hot water furnace as defined in claim 1, wherein said water container means includes a further cylindrically-shaped water container concentrically mounted relative to said outer and inner water container means.

8. The hot water furnace as defined in claim 1, wherein a plurality of transfer conduits fluidly communicate with said outer and inner water container means.

9. A fuel-fired furnace of claim 3 and further comprising:

combustion chamber means in which said combustion process occurs, said horizontal primary combustion chamber has a refractory lining portion for returning radiant heat back to the combustion process to augment vaporizing fuel spray being emitted from the supply means.

10. The furnace as defined in claim 9, wherein said secondary combustion chamber includes a necked-down portion which serves to restrict a flow of said combustion gases out of said secondary combustion chamber for return of radiant heat into the secondary chamber and prevents cooler gases from entering the secondary combustion chamber and into said heat exchanger means.

11. A fuel-fired furnace of claim 3 wherein:

said breaching damper further includes a primary controller shut down switch such as a mercury switch which is activated to operate in response to said damper assuming a closed and near closed position.

12. The furnace as defined in claim 11, wherein said breaching damper further includes the use of an overdraft damper opening means.

13. The furnace as defined in claim 12, wherein said overdraft damper opening means includes the use of a weighted stop arm operable to retain said damper in a first preselected run position and further being operable to permit said damper to open to a position which allows an increase in flow of combustion gases through said breaching tube in response to an increase in combustion gas pressure within said furnace above an acceptable level.

14. The hot water furnace as defined in claim 1, wherein said side container means excluding said domestic hot water heater is provided with loosely placed coils therein through which said domestic water supply passes without coming into fluid contact with said furnace water utilized for heating the same.

15. The hot water furnace as defined in claim 14, wherein a water circulating pump is provided to assist a flow of said furnace water through said side container means including said domestic hot water heater so as to facilitate a heating of said domestic water supply.

16. The hot water furnace as defined in claim 15, wherein an aquastat is provided in combination with said side container means including said domestic hot water heater, said aquastat serving to control operation of said water circulating pump.

* * * * *